US008180068B2

(12) United States Patent
Fujii et al.

(10) Patent No.: US 8,180,068 B2
(45) Date of Patent: May 15, 2012

(54) NOISE ELIMINATING APPARATUS

(75) Inventors: Kensaku Fujii, Himeji (JP); Satoshi Miyata, Kobe (JP)

(73) Assignee: TOA Corporation, Kobe-shi (JP)

( * ) Notice: Subject to any disclaimer, the term of this patent is extended or adjusted under 35 U.S.C. 154(b) by 764 days.

(21) Appl. No.: 11/817,868

(22) PCT Filed: Mar. 7, 2006

(86) PCT No.: PCT/JP2006/304378

§ 371 (c)(1),
(2), (4) Date: Feb. 11, 2009

(87) PCT Pub. No.: WO2006/095736

PCT Pub. Date: Sep. 14, 2006

(65) Prior Publication Data

US 2009/0214054 A1 Aug. 27, 2009

(30) Foreign Application Priority Data

Mar. 7, 2005 (JP) ..... 2005-062935

(51) Int. Cl.
*H04R 1/02* (2006.01)

(52) U.S. Cl. ..... 381/92; 381/93; 381/94.1

(58) Field of Classification Search ..... 381/92, 381/93, 94.1

See application file for complete search history.

(56) References Cited

U.S. PATENT DOCUMENTS

| | | | | |
|---|---|---|---|---|
| 2002/0114472 | A1* | 8/2002 | Lee et al. | 381/71.12 |
| 2003/0108214 | A1* | 6/2003 | Brennan et al. | 381/94.7 |

FOREIGN PATENT DOCUMENTS

| | | | |
|---|---|---|---|
| JP | 06-067693 | | 3/1994 |
| JP | 6-67693 A | * | 3/1994 |
| JP | 06-075591 | | 3/1994 |
| JP | 06-118967 | | 4/1994 |

OTHER PUBLICATIONS

International Search Report for Application No. PCT/JP2006/304378, dated Jun. 5, 2006.

Amitani et al., "A Study on Microphone Array Using Signal Analysis and Synthesis", The Institute of Electronics, Information and Communication Engineers.

* cited by examiner

*Primary Examiner* — Phat X Cao

(74) *Attorney, Agent, or Firm* — Marshall, Gerstein & Borun LLP

(57) ABSTRACT

A noise eliminating apparatus includes a first microphone, a second microphone and a signal processing unit, the signal processing unit includes a linear prediction filter and a noise resynthesis filter, the linear prediction filter receives an output signal of the first microphone, predicts the output signal of the first microphone by linear prediction and generates a prediction signal, and the noise resynthesis filter is an adaptive filter which receives, as a main input signal, a first difference signal obtained by subtracting one of the output signal of the first microphone and the prediction signal from the other, receives, as an error signal, a second difference signal obtained by subtracting one of an output signal of the second microphone and an output signal of the noise resynthesis filter itself from the other, and updates a filter coefficient so that the error signal is minimized.

3 Claims, 4 Drawing Sheets

NOISE ELIMINATING APPARATUS

TECHNICAL FIELD

The present invention relates to a noise eliminating apparatus which eliminates a noise component from an output signal of a microphone.

BACKGROUND ART

There exists a technique of receiving a sound wave (speaking voice, etc.) containing a noise with a microphone and eliminating a noise component from an output signal of the microphone. For example, Nonpatent Document 1 describes a study on elimination of the noise component.

Nonpatent Document 1: Amitani and others, SHINGAKUGIHOU, US84-98, pp. 41-46, January 2002.

DISCLOSURE OF THE INVENTION

Problems to be Solved by the Invention

However, in some cases, a conventional noise eliminating apparatus cannot effectively eliminate the noise component, or causes sound wave distortion due to the elimination of the noise component.

An object of the present invention is to provide an apparatus which eliminates the noise component from the mixture of noise and sound wave (speaking voice, etc.) and carries out such a process that the sound wave (speaking voice, etc.) can be heard clearly.

Means for Solving the Problems

To solve the above problems, a noise eliminating apparatus of the present invention comprises a first microphone, a second microphone and a signal processing unit, wherein: the signal processing unit includes a linear prediction filter and a noise resynthesis filter; the linear prediction filter receives an output signal of the first microphone, predicts the output signal of the first microphone by linear prediction and generates a prediction signal; and the noise resynthesis filter is an adaptive filter which receives, as a main input signal, a first difference signal obtained by subtracting one of the output signal of the first microphone and the prediction signal from the other, receives, as an error signal, a second difference signal obtained by subtracting one of an output signal of the second microphone and an output signal of the noise resynthesis filter itself from the other, and updates a filter coefficient so that the error signal is minimized.

In the noise eliminating apparatus, a coefficient vector of the noise resynthesis filter at a time j+1 may be produced by adding an update vector to a coefficient vector at a time j, and when a magnitude of the update vector determined by an adaptive algorithm applied by the noise resynthesis filter is larger than a predetermined value, the magnitude of the update vector may be reduced so as to become the predetermined value without changing a direction of the update vector, and the coefficient vector of the noise resynthesis filter may be updated by the reduced update vector.

Moreover, in the noise eliminating apparatus, the adaptive algorithm applied by the noise resynthesis filter may be a learning identification method.

Moreover, in the noise eliminating apparatus, the linear prediction filter may be an adaptive filter which receives the first difference signal as the error signal, and updates the filter coefficient so that the error signal is minimized.

Effects of the Invention

The noise eliminating apparatus of the present invention can effectively eliminate the noise component without distorting the sound wave.

EXPLANATION OF REFERENCE NUMBERS

A, B: microphone

BEST MODE FOR CARRYING OUT THE INVENTION

Figure 1A:
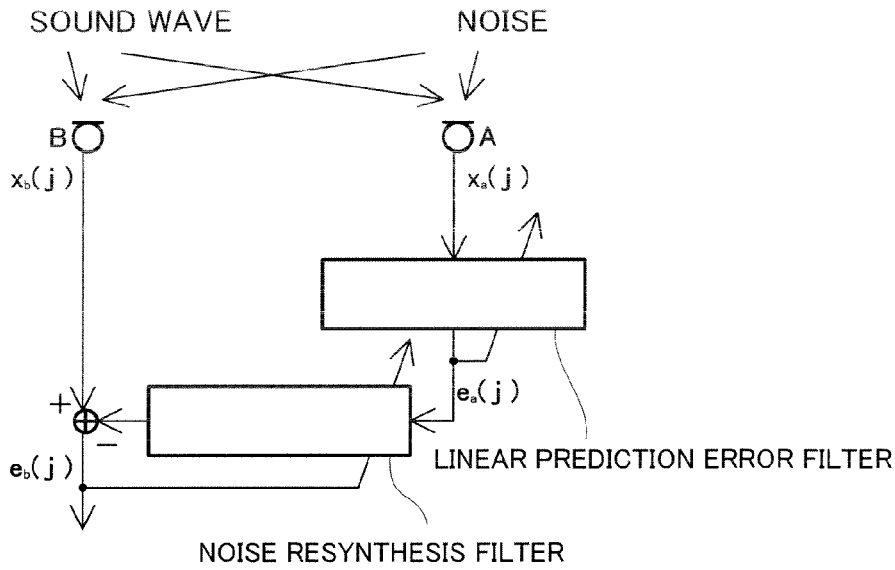
FIG. 1*a* is a view showing a basic structure of a proposed noise eliminating apparatus.

A basic structure of a proposed noise eliminating apparatus is shown in FIG. 1*a*. The noise eliminating apparatus of the present embodiment shown in FIG. 1*a* applies linear predictive analysis to a signal, shown by Formula (1) below, inputted to a microphone A at a time j.

Formula (1)

$$x_a(j)=s_a(j)+n_a(j) \quad [1a]$$

Then, the noise eliminating apparatus generates a prediction residual, shown by Formula (2) below, obtained as a result of the above analysis.

Formula (2)

$$e_a(j)=s'_a(j)+n'_a(j) \quad [1b]$$

In these formulas, $s_a(j)$ denotes a sound wave captured by a microphone A, $n_a(j)$ denotes a noise, $s'_a(j)$ denotes a prediction residual of the sound wave, and $n'_a(j)$ denotes a prediction residual of the noise.

Any type of linear prediction error filter may be adopted as a linear prediction error filter of FIG. 1*a*. One example of a structure of the linear prediction error filter is shown in FIG. 1*b*.

Figure 1B:
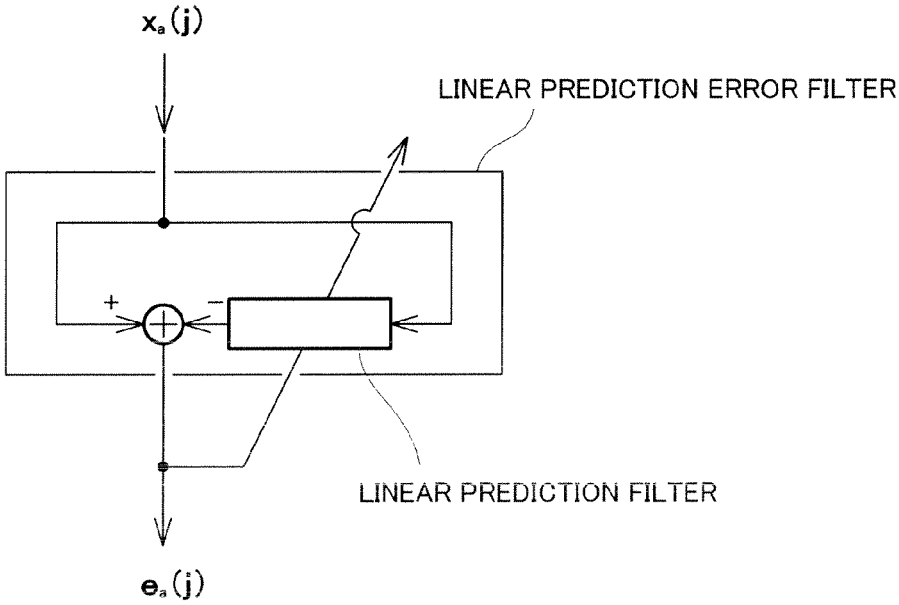
FIG. 1*b* is a view showing a structure of a linear prediction error filter.

The linear prediction error filter of FIG. 1*b* is mainly comprised of a subtracter and an FIR linear prediction filter.

The signal $x_a(j)$ having been inputted to the linear prediction error filter branches inside the linear prediction error filter, and the branched signals are respectively inputted to the subtracter and the linear prediction filter. To the subtracter, an output signal y(j) of the linear prediction filter is also inputted. The subtracter subtracts the signal y(j) from the signal $x_a(j)$, and outputs a signal $e_a(j)$ as the prediction residual obtained as a result of the subtraction.

The linear prediction filter is an FIR filter whose number of taps is P. The output signal y(j) of the linear prediction filter is shown by the following formula.

$$y(j) = \sum_{i=1}^{P} h_i(j) \cdot x_a(j-i) \quad [2]$$

In this formula, hi(j) denotes an i-th filter coefficient.

The filter coefficient $h_i(j)$ is updated so that the power of the prediction residual signal $e_a(j)$ is minimized. A learning algorithm (adaptive algorithm) is used for this updating. The learning algorithm (adaptive algorithm) used here may be any type of adaptive algorithm, and for example, an LMS algorithm, an RLS algorithm or an NLMS algorithm (learning identification method) may be used.

Next, a noise resynthesis filter synthesizes $x'_b(j)$, shown by Formula (3) below, using the prediction residual $e_a(j)$.

Formula (3)

$$x'_b(j)=s'_b(j)+n'_b(j) \quad [3]$$

In Formula (3), $s'_b(j)$ denotes a resynthesized sound wave, and $n'_b(j)$ denotes a resynthesized noise.

Meanwhile, a signal, shown by Formula (4) below, generated by overlapping a sound wave $s_b(j)$ with a noise $n_b(j)$ is inputted to a microphone B.

Formula (4)

$$x_b(j)=s_b(j)+n_b(j) \quad [4]$$

Therefore, in the noise eliminating apparatus of the present embodiment, if the noise resynthesis filter can synthesize only a signal shown by Formula (5) below, an enhanced sound wave shown by Formula (6) below can be obtained as an output of the noise eliminating apparatus of the present embodiment.

Formula (5)

$$n_b(j)\approx n'_b(j) \quad [5]$$

Formula (6)

$$e_b(j)\approx s_b(j) \quad [6]$$

This resynthesis of the noise is carried out simultaneously with system identification in which a sound propagation path from the microphone A to the microphone B is an unknown system. Therefore, due to the identification, a blind corner is caused to be adaptively directed to a noise arrival direction.

The noise resynthesis filter is an adaptive filter. The learning algorithm (adaptive algorithm) applied by the noise resynthesis filter may be any type, such as the LMS algorithm or the RLS algorithm. Especially, by using the NLMS (Normalized-LMS: learning identification method) as the learning algorithm, a high effect (noise eliminating effect) of suppressing noise with comparatively less computation can be obtained. However, echoey distortion of the sound wave (speaking voice) occurs. A component for reducing this distortion is added.

Since the signal inputted to the noise resynthesis filter contains the sound wave and the noise as shown in Formula (3), the noise resynthesis filter resynthesizes both the sound wave and the noise. However, synthesizing only the noise is ideal, and the output sound wave is distorted since the sound wave is also synthesized. The sound wave distortion is significant when the NLMS is used as the learning algorithm, since the noise resynthesis filter functions well.

If the noise resynthesis filter is intended only to the noise, the sound wave distortion should be reduced.

A value of an updated term of NLMS, shown by Formula (7) below, is small when the input is only the noise.

Formula (7)

$$\frac{\mu \cdot e_b(j) \cdot x_b(j)}{\|x_b(j)\|} \quad [7]$$

The value becomes large when the sound wave is inputted. Accordingly, proposed here is a method for using an appropriate threshold value in the updated term of the NLMS to carry out a clip process.

The term "clip process" used herein is a process of, when the magnitude of a parameter update vector determined by the adaptive algorithm applied by the noise resynthesis filter is larger than a predetermined value (threshold value), reducing the parameter update vector so that the magnitude of the vector becomes the predetermined value without changing its direction. By the parameter update vector whose magnitude is reduced to the predetermined value, a parameter value of the noise resynthesis filter is updated.

Figure 2:
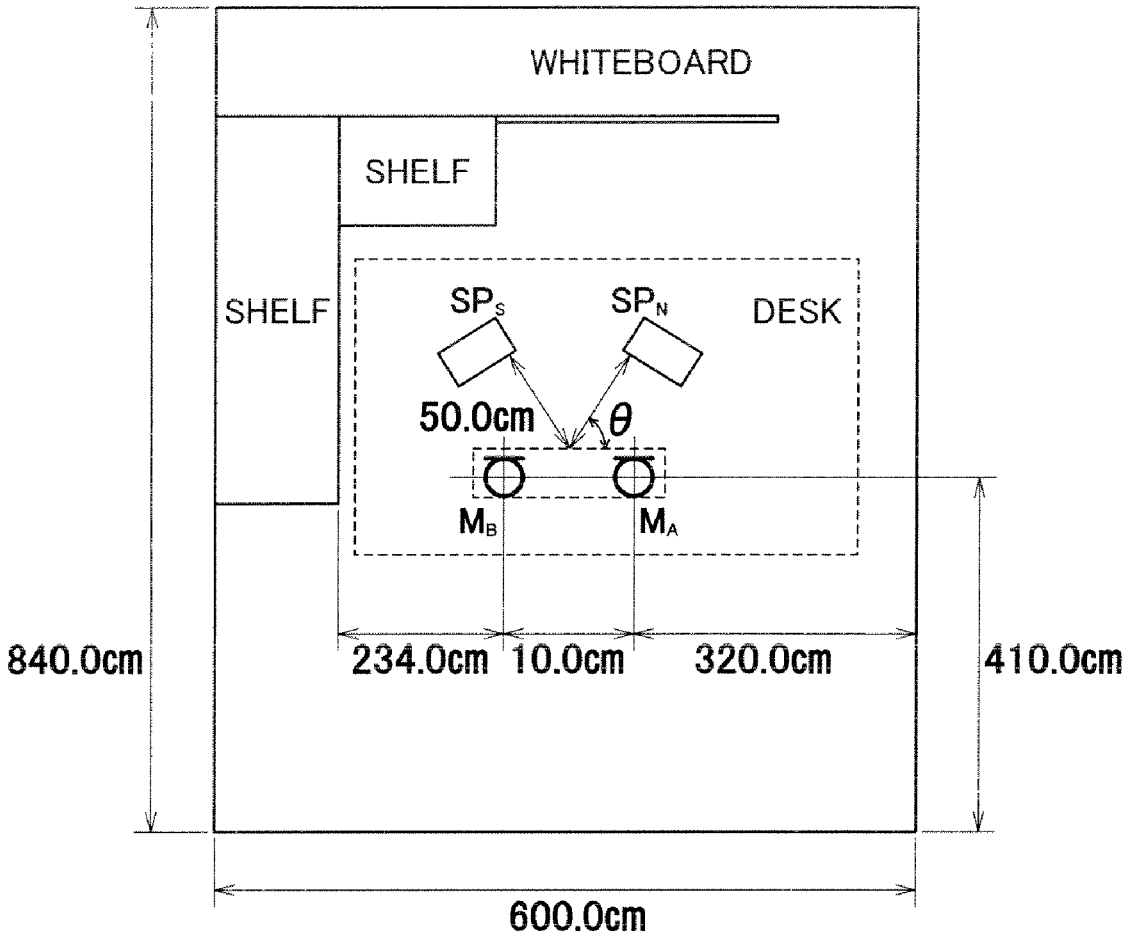
FIG. 2 is a view showing an experimental environment.

The applicant carried out an experiment under an environment of FIG. 2. In FIG. 2, an $SP_S$ denotes a speaker which outputs a sound wave, an $SP_N$ denotes a speaker which outputs a noise, an $M_A$ denotes the microphone A, and an $M_B$ denotes the microphone B.

The speakers and the microphones were placed on a table whose height was 70 cm from a floor surface and 200 cm from a ceiling, the interval between the microphones was 10.0 cm, the $SP_S$ was placed at an angle θ of 135 degrees, and the $SP_N$ was placed at an angle θ of 45 degrees. This corresponds to a path difference of 7.07 cm (1.66 wavelengths with respect to an upper limit frequency of 8 kHz when the sonic speed is 340 m). An A-weighted background noise at an experimental place was 46.5 dB. A male announcement was used as the sound wave, and a colored noise that is a fake jet fan noise whose peak is about 1 kHz was used as the noise.

Table 2 shows the throughput, memory utilization, etc. of each of the linear prediction error filter (LPEF) and the noise resynthesis filter (NRF) when each filter is incorporated into a DSP of Table 1. Used as a threshold value of an updated term clip was 0.0001.

TABLE 1

Performance of DSP

| Name of Device | Operating Frequency [MHz] | MIPS | Embedded Memory [word] ROM | Embedded Memory [word] RAM |
|---|---|---|---|---|
| TMS320VC5510 | 200 | 400 | 16 K | 160 K |

TABLE 2

| Program Evaluation (fs = 16 kHz) | | | | | |
|---|---|---|---|---|---|
| | Learning Algorithm | Number of Taps | Step Size | Throughput [MIPS] | Memory Utilization [word] |
| LPEF | LMS | 256 | 0.01 | 29.2 | Program: 0.63 K |
| NRF | NLMS | 64 | 0.01 | 28.1 | Data: 1.70 K |
| | | | Total | 57.4 | 2.33 K |

Figure 3:
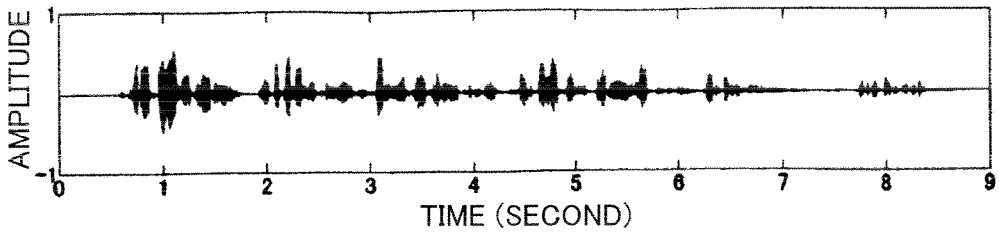
FIG. 3 is a view showing a sound waveform inputted to a microphone B.
Figure 4:
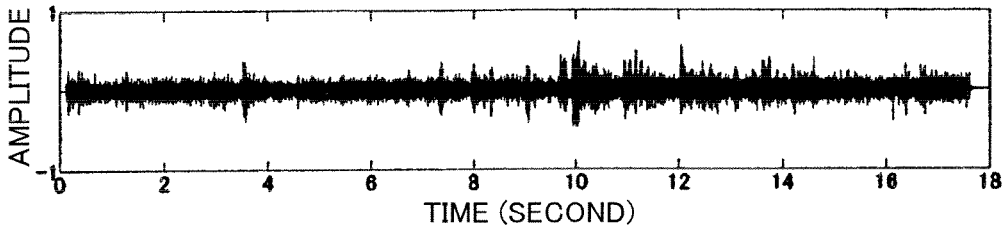
FIG. 4 is a view showing a noise overlapping sound waveform observed in the microphone B.
Figure 5:
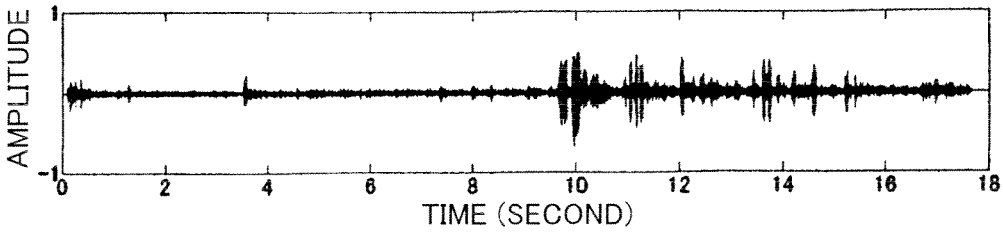
FIG. 5 is a view showing an enhanced sound waveform produced by a proposed noise eliminating apparatus.

An experiment of suppressing the noise was carried out under the above conditions. An original sound waveform, a noise overlapping sound waveform and an enhanced sound waveform are respectively shown in FIGS. 3, 4 and 5. From these results, a noise suppressing effect of the proposed system could be confirmed.

By carrying out the clip process of the updated term, the sound wave distortion is apparently reduced to human ears. To quantitatively evaluate this reduction, a sound quality evaluation value VE below was calculated.

Formula (8)

$$VE = 10 \times \log_{10} \frac{\sum_{j=1}^{N} e_b^2(j)}{\sum_{j=1}^{N} \{e_b(j) - s_b(j)\}^2} \quad [8]$$

Since the sound wave inputted to the microphone B is necessary to calculate the value VE, the value VE can be calculated only by a simulation. The value VE was calculated by a computation simulation using an input SNR (SN ratio) of −3 dB, and the same sound wave and noise as those used in the above experiment.

TABLE 3

| Comparison of Evaluation Values | | |
|---|---|---|
| Clip Process of Updated Term | Input SNR [dB] | VE [dB] |
| Not Carried Out | −3.00 | 3.30 |
| Carried Out | −3.00 | 3.33 |

It can be seen that the value VE is slightly better when the clip process of the updated term was carried out.

Figure 6:
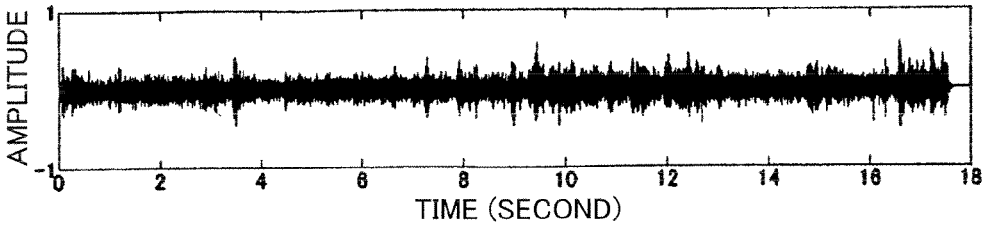
FIG. 6 is a view showing the noise overlapping sound waveform observed in the microphone B.
Figure 7:
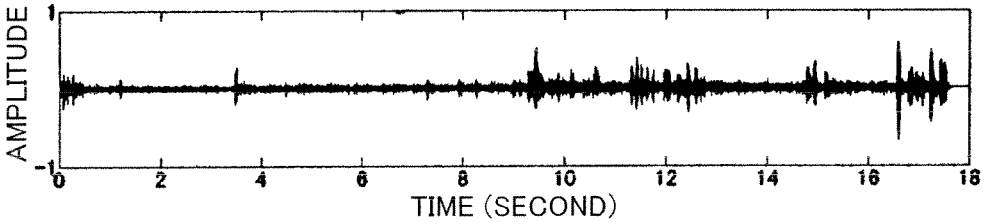
FIG. 7 is a view showing the enhanced sound waveform produced by the proposed noise eliminating apparatus.

Moreover, in view of the use in the actual environment, the same experiment was carried out under the same environment and conditions as above except that the noise of crowds was collected and used as the noise. From the results shown in FIGS. 6 and 7, the effectiveness of the proposed method was confirmed even in the case of the noise of crowds that is overlapping of human voices. In addition, it was confirmed with human ears that the sound wave distortion was reduced by carrying out the clip process of the updated term.

As above, a noise suppressing apparatus (noise eliminating apparatus) using two microphones was proposed, and its noise suppressing effect was confirmed by the experiment using the real DSP apparatus. Moreover, a solution was proposed for the sound wave distortion generated when the NLMS was used as the learning algorithm of the noise resynthesis filter, and its effectiveness was also confirmed.

Since the noise component can be eliminated from the output signal of the microphone by using the noise eliminating apparatus of the present invention, the present invention is applicable to a technical field of electro-acoustics.

Thus, the noise eliminating apparatus that is one embodiment of the present invention is explained.

Whereas the above embodiment illustrated the noise eliminating apparatus in which the linear prediction filter is the adaptive filter, the linear prediction filter of the noise eliminating apparatus does not have to be the adaptive filter.

From the foregoing explanation, many modifications and other embodiments of the present invention are obvious to one skilled in the art. Therefore, the foregoing explanation should be interpreted only as an example, and is provided for the purpose of teaching the best mode for carrying out the present invention to one skilled in the art. The structures and/or functional details may be substantially modified within the spirit of the present invention.

The invention claimed is:

1. A noise eliminating apparatus comprising a first microphone, a second microphone and a signal processing unit, wherein:

the signal processing unit includes a linear prediction filter and a noise resynthesis filter;

the linear prediction filter receives an output signal of the first microphone, predicts the output signal of the first microphone by linear prediction and generates a prediction signal; and the noise resynthesis filter is an adaptive filter which receives, as a main input signal, a first difference signal obtained by subtracting one of the output signal of the first microphone and the prediction signal from the other, receives, as an error signal, a second difference signal obtained by subtracting one of an output signal of the second microphone and an output signal of the noise resynthesis filter itself from the other, and updates a filter coefficient so that the error signal is minimized; and a clip process is performed using a predetermined threshold value in an updated term of an adaptive algorithm applied to the noise resynthesis filter, and wherein the clip process is a process in which, when a magnitude of the updated term is larger than the threshold value, the updated term is reduced so that the magnitude of the updated term becomes the threshold value, and the filter coefficient of the noise resynthesis filter is updated based on the updated term having been reduced to the threshold value.

2. The noise eliminating apparatus according to claim 1, wherein the adaptive algorithm applied by the noise resynthesis filter is a learning identification method.

3. The noise eliminating apparatus according to claim 1, wherein the linear prediction filter is an adaptive filter which receives the first difference signal as the error signal, and updates the filter coefficient so that the error signal is minimized.

* * * * *